United States Patent [19]

Miyashiro

[11] 4,104,510

[45] Aug. 1, 1978

[54] EXPOSURE CORRECTION CALCULATOR FOR TAKING CLOSE-UP PICTURES

[76] Inventor: Clifford M. Miyashiro, 5267 Tendella Ave., Woodland Hills, Calif. 91364

[21] Appl. No.: 733,265

[22] Filed: Oct. 18, 1976

[51] Int. Cl.[2] ..... G06C 3/00

[52] U.S. Cl. ..... 235/64.7

[58] Field of Search ..... 235/64.7; 116/114 J

[56] References Cited

U.S. PATENT DOCUMENTS

| | | | |
|---|---|---|---|
| 1,207,448 | 12/1916 | Venable | 235/64.7 |
| 2,105,255 | 1/1938 | Mihalgi et al. | 235/64.7 |
| 2,436,966 | 3/1948 | Legris | 235/64.7 |
| 3,117,722 | 1/1964 | Bugelholl | 235/64.7 |
| 3,199,776 | 8/1965 | Koch | 235/64.7 |

*Primary Examiner*—Stephen J. Tomsky

*Attorney, Agent, or Firm*—Victor Sepulveda

[57] ABSTRACT

The calculator of this invention is designed to be employed when the lens is extended from the camera body. The calculator includes a measurement scale to be positioned in the desired position to take the picture of the subject. The width of the viewfield is determined. The measurement scale has printed thereon different measurement values. Associated with each measurement value is a series of camera adjustment factors which is to note to the user suggested adjustments to compensate for the lens extension from the camera body.

1 Claim, 4 Drawing Figures

EXPOSURE CORRECTION CALCULATOR FOR TAKING CLOSE-UP PICTURES

BACKGROUND OF THE INVENTION

The field of this invention relates to a photographic calculator and more particularly to a calculating device for obtaining camera, flash, or film adjustment data when taking closeup pictures.

It is common practice in the taking of flash exposures to consider several variables in order to obtain a high quality picture. Examples of these variables are the exposure time, the distance the subject is from the flash, the film speed rating, and the "f" number (or aperture opening). A light intensity measuring device is employed with this device being placed adjacent the subject to be photographed. The quantity of light is measured and this measurement is to be employed to make appropriate settings on the camera or the flash equipment in order to achieve a high quality photograph.

However, once when the viewfield of the camera is in the range of 3.6 to 360 millimeters, the adjustments determined by the light intensity measuring device are not accurate to obtain a high quality photograph. These suggested adjustments should be modified to compensate for the extension of the lens.

SUMMARY OF THE INVENTION

The present invention includes a calculator useful in making camera adjustments when taking close-up exposures. Briefly described an elongated member having a first scale thereon which includes indicia imprinted thereon in the form of a plurality of numbers being disposed along the elongated line of the member which is a measurement indicative of the length of the desired field of view of the picture being taken. A second scale is provided on the member which are indicative of the magnification ratio of the close-up picture being taken. The elongated member includes an area extended therefrom which is substantially longer in shape than the width of the scale. The member has a window opening in said extended area. A pivot opening is included in said extended area and a circular member is pivotally mounted to rotate at said pivot area exposing portions thereof in the window opening in said extended area. The circular member opening having a plurality of rows of indicias arranged in a circular pattern thereon and each indicia in said rows being a columnar arrangement extending along radii thereof. Each row in said columnar arrangment being indicative of a significant measurement for exposure settings on the camera when taking close-up pictures. The outside row of indicias being a number indicative of the length on said elongated members scale which is indicative of the length of the desired field of view measured by said elongated scale.

The primary objective of this invention is to design a calculating device which is to be employed to modify camera and/or flash adjustments which have been previously determined. In normal manner, a light intensity meter is used. The need for these camera adjustments is required if the lens is extended for close focusing.

DETAILED DESCRIPTION OF THE SHOWN EMBODIMENT

Figure 3:
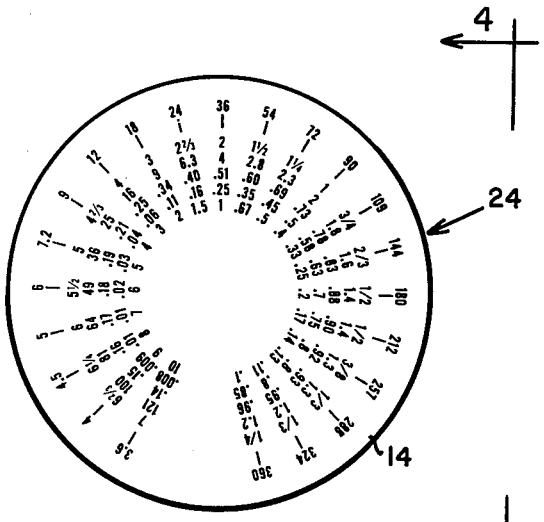
FIG. 3 is a front elevational view of the movable scale member employed in conjunction with the device of this invention.
Figure 4:
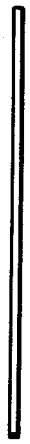
FIG. 4 is a side view of the movable scale member taken along line 4—4 of FIG. 3.
Figure 2:
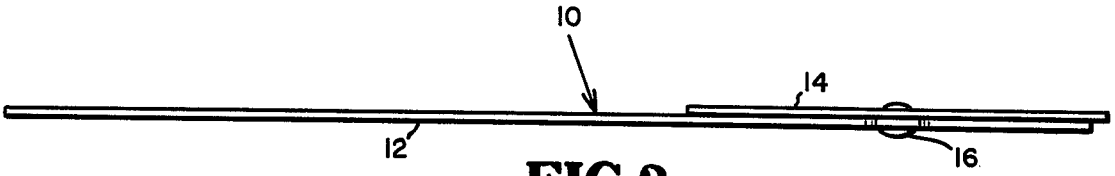
FIG. 2 is a top view of the calculator of FIG. 1.
Figure 1:
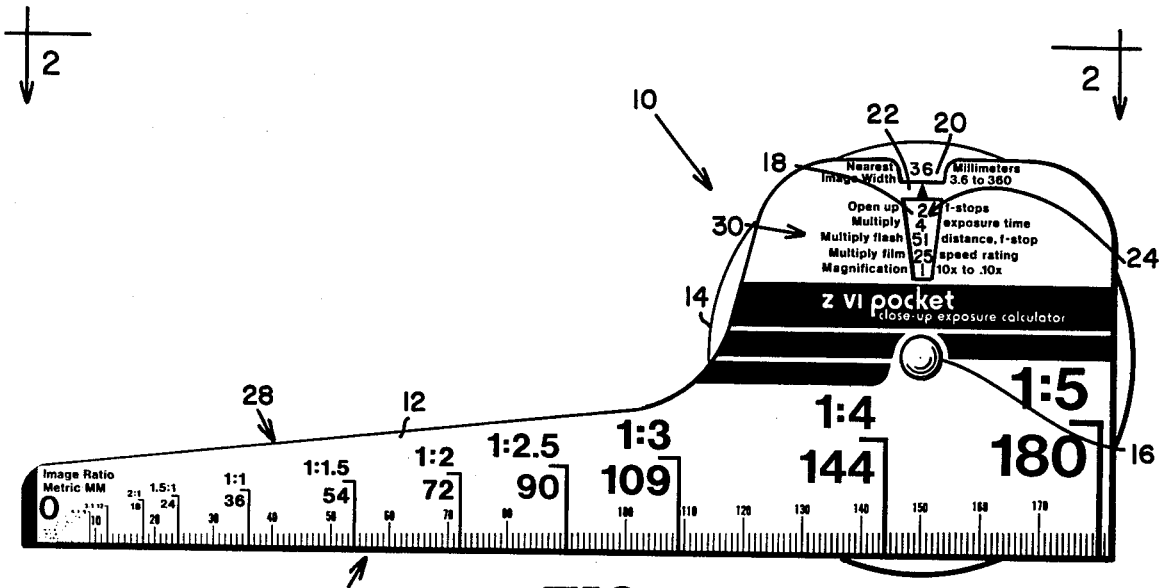
FIG. 1 is a front elevational view of the calculator of this invention.

Referring particularly to the drawing, there is shown in FIGS. 1 and 2 the calculator 10 of this invention which is composed primarily the main sheet material 12 and a scale member of 14. Both the scale member 14 and the main member 12 are formed of sheet material such as paper, plastic, or the like.

The scale member 14 is rotatedly mounted by means of pivot pin 16 to the main member 12. Formed within the main member 12 is a polygonal shaped opening 18 and a recess opening 20. A bridge 22 separates the recess opening 20 from the opening 18.

Formed upon the front surface of the scale member 14 is a series of indicia 24. Indicia 24 is formed of separate columns and is in the form of numerals. The numeral nearest the periphery of the scale member 14 is to be a measurement numeral and ranges from 3.6 to 360 with there being a selected number of values there between. These numerals are to stand for millimeters. This numeral is located to be observable through the recess opening 20. The remaining numerals in the column are observable through the opening 18.

Located on the surface of the main member 12 is a measurement scale 26. The measurement scale 26 is also in millimeters and has values from 3.6 to 180. It is to be noted that there are specific accentuated numerical values such as 18, 24, 36, 54, 72, 90 and so forth. Each of these numbers have an appropriate column of indicia within the group of indicia 24.

Also located on the main member 12 adjacent the indicia 26 is indicia 28. The indicia 28 is merely for information purposes only and denotes the image ratio. For example, if within the viewfinder of the camera, the distance between the left edge of the viewfield and right edge of the viewfield measures 72 millimeters (from 0 to numeral 72 on indicia 26), the resulting picture will show the subject reduced in size by 50 percent (1:2). Different values of image ratio will be obtained for the different distances.

Also located on the exterior surface of the main member 12 is a third type of indicia 30. The indicia 30 is located adjacent opening 18. The indicia 30 occupies five different lines with the first line being "open up *f*-stops". the second line being "multiply exposure time", the third line being "multiply flash distance, *f*-stop",the fourth line being "multiply film speed rating", and the fifth line being "magnification 10X to 0.10X". Each line of indicia 30 corresponds to a particular numeral located in the column of numerals of the indicia 24.

The operation of the calculator of this invention is as follows:

The camera (not shown) is positioned to take the desired picture. The camera will normally be mounted upon a tripod or fixed in some other manner and will be located quite close to the subject matter of which the picture is to be taken. A light intensity meter is placed adjacent the subject matter and a reading determined. From this reading camera adjustments are made in the conventional manner.

The device 10 of this invention is now used by being placed next to the subject matter. The zero's point on the measurement scale 26 is placed at the left edge of the viewfield of the camera's viewfinder. The member 12 is placed parallel to the film of the camera and normally will be placed directly on or directly adjacent to the subject matter to be photographed. The number at the right side of the viewfield is then noted and let it be assumed that that number is thirty-three millimeters.

Observing the scale 26, it is noted that the number thirty-three is more near number thirty-six than the number twenty-four. The operator then rotates member 14 until the number thirty-six shows as is shown in FIG. 1 of the drawing. The operator can then determine from the indicia 30 that there is a one to one magnification which is for information purposes only. However, in order to take sharp clear pictures, the operator must do one of the following changes and that is to either open up the f-stops two clicks or multiply the exposure time by 4, or decrease the flash distance by 50 percent, or multiply the film speed rating by 0.25. Only one of these changes is to be made depending upon which change the operator wishes to make.

It is be noted that scale 26 is only 180 millimeters in length. The scale member 14 includes the additional columns 212 millimeters, 257 millimeters, 288 millimeters, 324 millimeters, and 360 millimeters. In an effort to keep the physical size of the calculator minimal, the measuring scale 26 is only the distance of 180 millimeters. However, distances between 180 and 360 millimeters can be approximated satisfactorily.

What is claimed is:

1. A calculator useful in making camera adjustments when taking close-up exposures including:

an elongated member having a first scale, said first scale including indicias imprinted thereon which includes a plurality of spaced numbers disposed along the elongated line of said member and being a measurement indicative of the length of a desired field of view, said scale includes a second row of numbers placed therealong which is indicative of a magnification ratio of the field of view of the exposed closeup exposures;

an extended area on said elongated member being substantially wider than said elongated member and including a window opening therein and a pivot opening spaced substantially below said window opening on alignment therewith; and, a circular member being pivotally mounted to said pivot opening in said elongated area whereby portions of said circular member being exposed in said window opening of said extended area on said elongated member, said circular member having a plurality of rows of indicia arranged in a circular pattern thereon and each indicia in said row being in a columnar arrangement extending along the radii thereof, each row in said columnar arrangement being indicative of a significant exposure factor for exposure settings on a camera when taking close-up pictures, the outside row of indicia on said circular member being a member corresponding to said numbers indicative of the length of said elongated member scale which is further indicative of the length of desired field of view measured by the scale on said elongated member, each row in its ordinal significance beginning with the outside of said circular member being a calculated figure for the opening of the *f*. stops on said camera, the multiple flash distance *f*. stops on said camera, the multiple film speed rating and the magnification ratio thereof.

* * * * *